US007182641B2

(12) United States Patent
Shimoyama

(10) Patent No.: US 7,182,641 B2
(45) Date of Patent: Feb. 27, 2007

(54) ELECTRICAL CONNECTOR WITH SHIELD CASE

(75) Inventor: Masao Shimoyama, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/444,335

(22) Filed: Jun. 1, 2006

(65) Prior Publication Data

US 2006/0292930 A1 Dec. 28, 2006

(30) Foreign Application Priority Data

Jun. 27, 2005 (JP) ..... 2005-186582

(51) Int. Cl.
*H01R 13/648* (2006.01)

(52) U.S. Cl. ..... 439/607

(58) Field of Classification Search ..... 439/567, 439/571, 572, 607
See application file for complete search history.

(56) References Cited

U.S. PATENT DOCUMENTS 5,192,228 A * 3/1993 Collins et al. ..... 439/567
5,401,192 A * 3/1995 Briones et al. ..... 439/607
6,299,461 B1 * 10/2001 Zhu et al. ..... 439/607
2005/0032426 A1 * 2/2005 Tanaka ..... 439/607

FOREIGN PATENT DOCUMENTS

JP 2005-32630 2/2005

* cited by examiner

*Primary Examiner*—Briggitte R. Hammond
(74) *Attorney, Agent, or Firm*—Takeuchi & Kubotera, LLP

(57) ABSTRACT

In an electrical connector with a shield case, the shield case made of a metal plate is attached to a housing having a front portion to be a fitting side relative to a mating connector. The shield case includes an engaging piece extending from a rear portion of the shield case. The engaging piece of the shield case fitted in is bent toward an outer surface of the housing to engage the housing. In the connector with the shield case, the engaging piece includes an attaching end portion at a portion thereof extending downwardly beyond a bottom surface of the connector after being bent toward the outer surface of the housing. The attaching end portion is inserted into a corresponding hole formed in an attaching object member of the connector for attaching to the attaching object member.

10 Claims, 5 Drawing Sheets

ELECTRICAL CONNECTOR WITH SHIELD CASE

BACKGROUND OF THE INVENTION AND RELATED ART STATEMENT

The present invention relates to an electrical connector with a shield case.

In an electrical connector disclosed in Patent Reference, a shield case is formed through punching a metal plate and bending the same, and is attached to a housing with a terminal disposed therein. In general, such a shield case is provided with an engaging piece for engaging a housing to prevent the shield case from coming off the housing.

As shown in FIG. 5, in the electrical connector disclosed in Patent Reference, a shield case 51 formed of metal with a rectangular cylindrical shape is attached to a housing 53 holding terminals 52. Each of the terminals 52 disposed in the housing 53 includes a connecting portion 52A having an end portion bent at a level of a bottom surface of the housing 53. In a state that the connector is disposed on a circuit board, the connecting portion 52A is connected to a corresponding circuit on the circuit board with solder and the like. The housing 53 includes an engaging protrusion 53A extending upwardly at rear portions thereof.

The shield case 51 is attached to the housing 53, and has a front opening to form a space for accommodating a mating connector (not shown). The shield case 51 with a rectangular cylindrical shape has a cut portion 51A at a rear upper edge portion thereof for engaging the engaging protrusion 53A. Engaging tongues 54 extending backwardly are disposed at both sides of the cut portion 51A. Further, the shield case 51 is provided with ground connecting portions 55 at lower portions thereof on both sides. The connecting portions 55 are bent and extend sideway, and are to be connected to a corresponding circuit on the circuit board with solder and the like.

In such a connector described above, the shield case 51 is fitted into the housing 53 from a front side. The cut portion 51A of the shield case 51 abuts against the engaging protrusion 53A of the housing 53 to define a standard fitting position. Afterward, as shown in FIG. 5, the engaging tongues 54 are bent downwardly toward a rear edge surface of the housing 53, so that the engaging tongues 54 engage engaging recess portion 53B formed in the rear edge surface of the housing 53. Accordingly, the shielding case 51 is restricted to move in a front-to-rear direction relative to the housing 53, and does not come off. In use, the connecting portions 55 and the connecting portions 52A of the terminals 52 are connected to corresponding circuits on the circuit board with solder and the like. The connector is fixed to the circuit board through the connection.

Patent Reference: Japanese Patent Publication No. 2005-032630

In the connector disclosed in Patent Reference, however, when an electrical device, for example, a mobile phone, with the connector mounted thereon is dropped in a state that a mating connector is connected to the connector, the electrical device receives a large impact, and an excessive force is directly applied to the housing from the mating connector. When the housing receives an excessive force, the engaging tongues may be opened with the force, and the housing may be slipped out from the shield case. That is because, between the housing and shield case, only the engaging tongues engage the housing at the upper rear end portions thereof. Therefore, the front portion moves up and down, so that the front portion is easily inclined relative to the rear portion. Especially when a space is formed between the shield case and the housing, the shield case easily comes off the housing due to the inclined state.

In view of the problems described above, an object of the present invention is to provide an electrical connector with a shied case, in which a shield case does not easily come off a housing in spite of a simple structure.

Further objects will be apparent from the following description of the invention.

SUMMARY OF THE INVENTION

According to the present invention, an electrical connector has a shield case. The shield case made of a metal plate is attached to a housing having a front portion to be a fitting side relative to a mating connector. The shield case includes an engaging piece extending from a rear portion of the shield case. The engaging piece of the shield case is bent toward an outer surface of the housing to engage the housing.

In the connector with the shield case described above, the engaging piece includes an attaching end portion at a portion thereof extending downwardly beyond a bottom surface of the connector toward the outer surface of the housing. The attaching end portion is inserted into a corresponding hole formed in an attaching object member of the connector for attaching to the attaching object member.

In the invention described above, the engaging piece of the shield case fitted into the housing holds the housing after being bent. At the same time, the attaching end portion of the engaging piece is directly inserted into the corresponding hole formed in the attaching object member, for example, a circuit board, for attaching the connector to the circuit board. In this case, the shield case firmly holds the housing through the circuit board at an upper portion and a lower portion of a rear end portion thereof. Accordingly, it is possible to withstand an excessive force, especially a twisting force generated when the housing is inclined upon receiving an external force.

According to the present invention, the engaging piece may extend linearly and backwardly from an upper rear end portion of the shield case. After being bent, the engaging piece is accommodated in an engaging groove formed in a rear surface of the housing within a corresponding range.

Further, the engaging piece may extend backwardly from the rear end side portion of the shield case, and may be bent at a right angle and extends to form an L character shape. After being bent, the engaging piece is accommodated in the engaging groove or a step portion formed in the rear surface of the housing within a corresponding range.

Further, the engaging piece may extend linearly and sideway from a rear end or a portion nearby of the shield case. After being bent, the engaging piece is accommodated in an engaging groove or a step portion formed in a rear side surface of the housing within a corresponding range.

According to the present invention, it is preferred that the engaging piece is fitted into the engaging groove in at lease a part of the corresponding range of the engaging groove of the housing. Accordingly, the engaging piece can engage the housing with a strong engaging force, thereby making it possible to prevent the engaging piece from coming off.

According to the present invention, it is preferred that the engaging piece has a base portion thereof having a width larger than a free end portion thereof. In this case, the engaging groove of the housing has a wide width groove portion having a width larger than the base portion of the engaging piece and a narrow width groove portion having a width smaller than the free end portion of the engaging piece. When the engaging piece is fitted into the engaging groove, the free end portion of the engaging piece is fitted into the narrow width groove portion. With the configuration, the engaging piece has the wide width groove portion having the wide width and strength strong enough to withstand a bending force. Although the narrow width groove portion has a small range, it is possible to obtain sufficient engagement through fitting in.

Further, according to the present invention, it is preferred that the housing has a stopper portion for abutting against the shield case when the shield case is fitted into a standard position. Accordingly, the shield case is automatically fitted into the standard position with the stopper portion, and it is possible to prevent the shield case from coming off in the fitting direction.

In the present invention described above, the engaging piece extends from the rear portion of the shield case to be fitted into the housing. After the shield case is attached to the housing, the engaging piece is bend toward the surface of the housing to hold the housing. At the same time, the attaching end portion extends downwardly beyond the bottom surface of the housing from the end portion of the engaging piece, and is directly inserted into the corresponding hole formed in the attaching object member such as the circuit board. Accordingly, the shield case is firmly held with the engaging piece through the circuit board of an electrical device. As a result, when the electrical device with the circuit board mounted thereon is dropped and an external force is applied to the housing, it is possible to prevent the housing from coming off the shield case.

DETAILED DESCRIPTION OF PREFERRED EMBODIMENTS

Hereunder, embodiments of the present invention will be explained with reference to the accompanying drawings.

Figure 1:
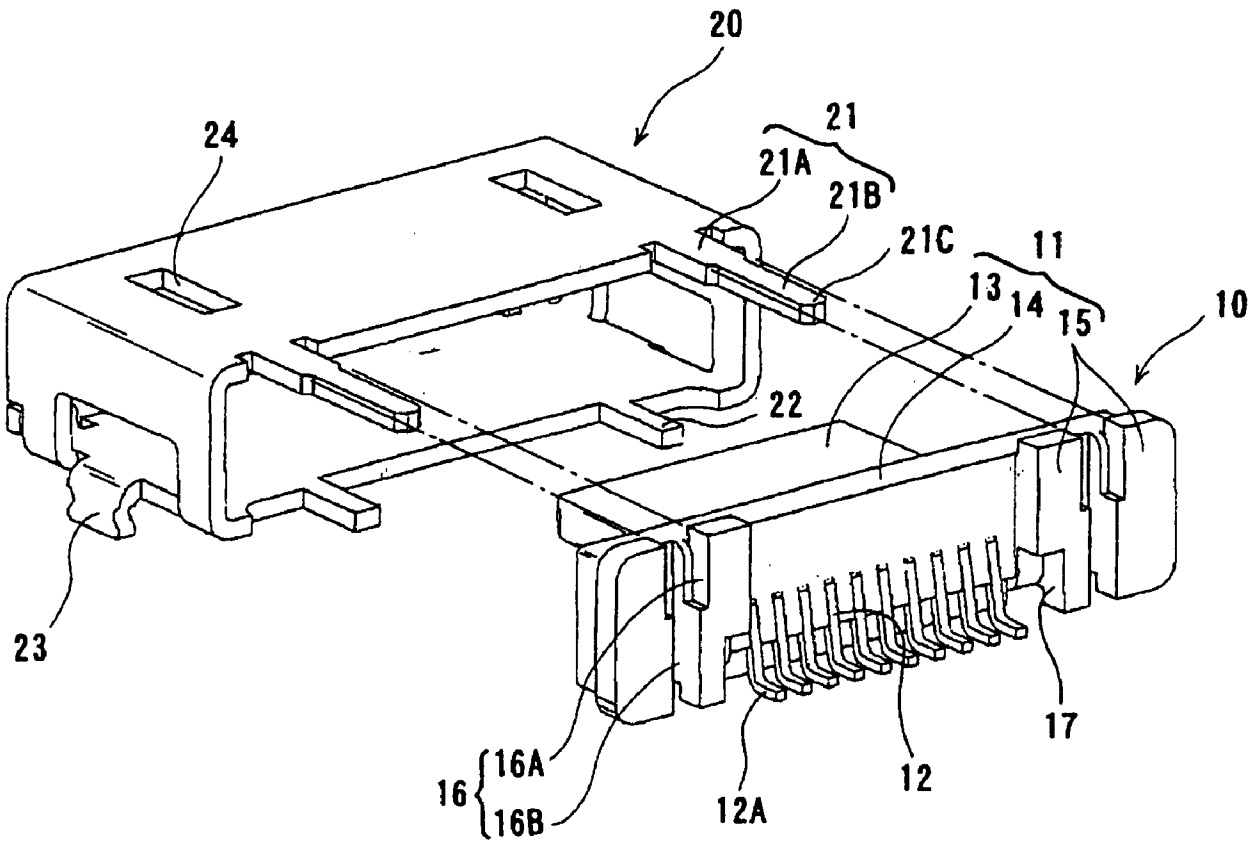
FIG. 1 is a perspective view showing a connector according to a first embodiment of the present invention in a state that a shield case is not attached to a connector main body.

As shown in FIG. 1, a shield case 20 is to be fitted into a connector main body 10. In the connector main body 10, a plurality of terminals 12 formed of a metal material is disposed in a housing 11 made of an insulating material. The housing 11 includes a fitting portion 13 having a rectangular cylindrical outer surface extending in a forward direction (toward left side in the figure) or a fitting direction relative to a mating connector (not shown); a shield case attaching portion 14 disposed behind the fitting portion 13 and having a rectangular cylindrical outer surface larger than the fitting portion 13; and stopper portions 15 disposed behind the shield case attaching portion 14.

When the shield case 20 (described in more detail later) is attached to the shield case attaching portion 14 from a front side, a circumference of the fitting portion 13 and the shield case 20 form a space for receiving a mating connector. At the same time, the stopper portions 15 abut against a rear end portion of the shield case 20 to define a fitting position of the shield case 20.

The stopper portions 15 are disposed at positions close to both ends of the housing 11 in a width direction, and have circumferential edges extending beyond an outer circumference of the shield case attaching portion 14 by a plate thickness of the shield case 20. The stopper portions 15 are provided with engaging groove portions 16 opened backwardly and passing through in a vertical direction. The engaging groove portions 16 have wide width groove portions 16A at an upper side thereof and narrow width groove portions 16B at a lower side thereof. The stopper portions 15 have lower groove portions (not shown) extending in a front-to-rear direction and formed in lower edge surfaces thereof, and cut portions 17 formed in rear surfaces thereof at an inner lower side in a width direction.

The terminals 12 are disposed in the housing 11. Each of the terminals 12 includes a contact portion situated in the fitting portion 13 of the housing 11 at a front end side thereof, and a connecting portion 12A at a rear end portion thereof extending from a rear surface of the housing 11 and bending downwardly in a crack shape on a level same as a bottom surface of the housing 11.

The shield case 20 to be attached to the connector main body 10 is formed in a rectangular cylindrical shape through punching a metal plate and bending the same. The shield case 20 has a rear portion having a rectangular cylindrical shape with a dimension and a shape to be fitted into the shield case attaching portion 14 of the housing 11 from a front side.

The shield case 20 includes engaging pieces 21 extending linearly and backwardly from two positions at an upper rear edge thereof. Each of the engaging pieces 21 has a base portion 21A having a wide width and a free end portion 21B having a narrow width. After the shield case 20 is attached to the connector main body 10, the engaging pieces 21 are bent downwardly toward the rear surface of the housing 11 at the rear edge positions of the shield case 20. Upon bending, the engaging pieces 21 have a dimension and a shape such that the base portions 21A are accommodated in the wide width groove portions 16A of the engaging groove portions 16 of the housing 11 while leaving a small space, and the free end portions 21B are fitted into the narrow width groove portions 16B. Further, the engaging pieces 21 have a length such that distal ends thereof protrude beyond the bottom surface of the shield case 20 upon being accommodated in the groove portions 16. The protruded portions form attaching end portions 21C to be inserted into corresponding holes (not shown) of a connector attaching object member such as a circuit board and the like.

In the shield case 20, sub-engaging pieces 22 having a length smaller that that of the engaging pieces 21 extend backwardly from a lower rear edge of the shield case 20 at two positions. When the shield case 20 is fitted into the connector main body 10, the sub-engaging pieces 22 are inserted into lower groove portions (described later) formed in bottom surfaces of the stopper portions 15 of the housing 11, so that front end surfaces of the sub-engaging pieces 22 protrude backwardly. More specifically, when the sub-engaging pieces 22 are bent upwardly, it is configured such that front end portions thereof are accommodated in the cut portions 17. Note that it is not necessary to provide the sub-engaging pieces 22 according to the present invention.

Ground connecting portions 23 bending downwardly are formed on side portions of the shield case 20 through cutting lower portions of the shield case 20 into a window shape. The ground connecting portions 23 have a size and a shape to be inserted into corresponding holes (not shown) of the connector attaching object member such as a circuit board and the like.

Further, locking holes 24 are formed in an upper surface of the shield case 20 for engaging locking portions of a mating connector having a hook shape and formed on front ends of locking arms of the mating connector.

In the connector according to the embodiment, the shield case 20 is attached to the connector main body 10 for use according to the following manner.

First, the shield case 20 in the state shown in FIG. 1 is fitted into the connector main body 10 from the front side. When the rear portion of the shield case 20 is fitted into the shield case attaching portion 14 of the housing 11, the rear edge of the shield case 20 abuts against the stopper portions 15 of the housing 11. Accordingly, the shield case 20 is placed at the fitting position, and does not come off backwardly.

Figure 2:
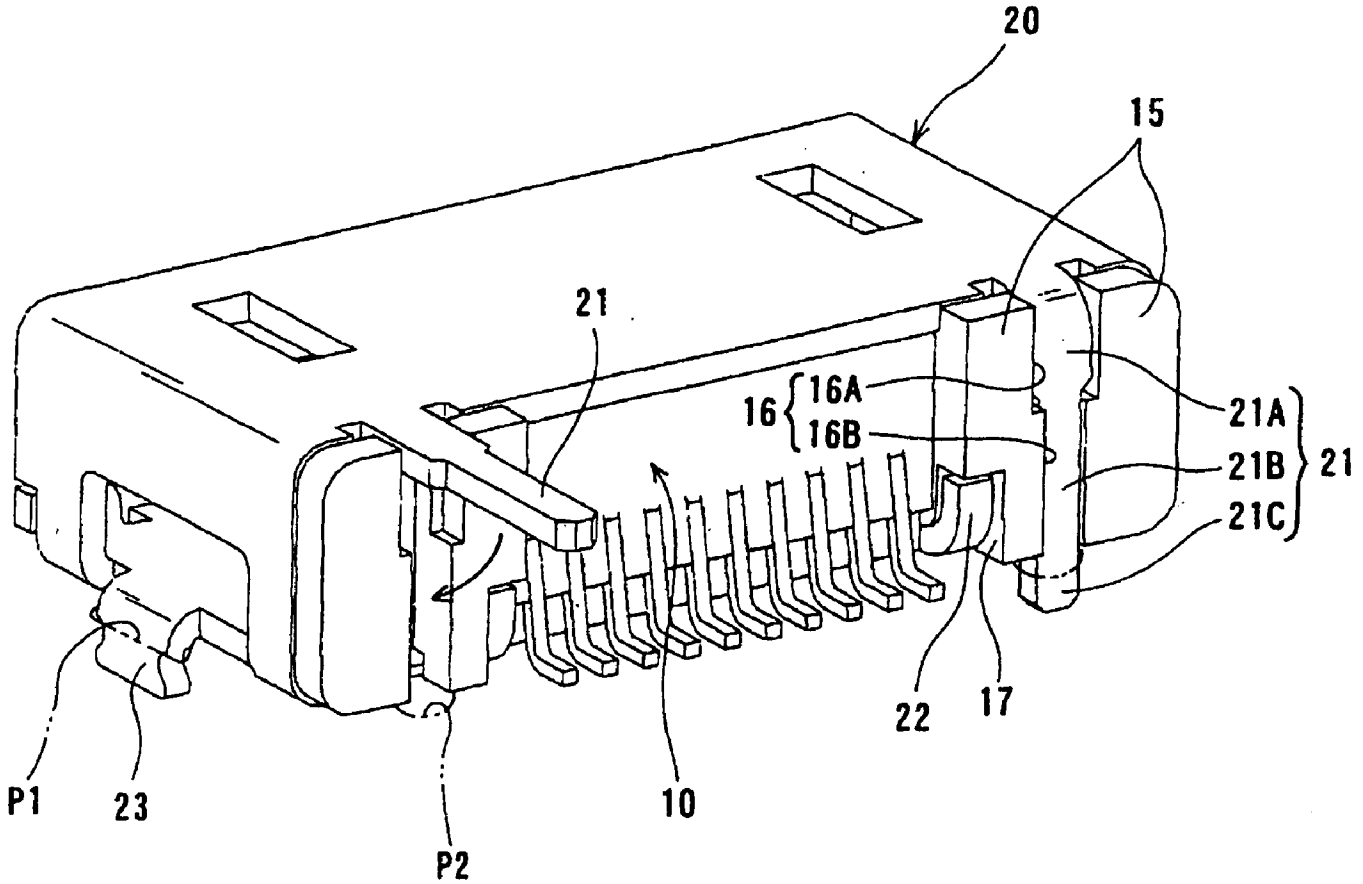
FIG. 2 is a perspective view the connector shown in FIG. 1 in a state that the shield case is attached to the connector main body.

When the shield case 20 is attached to the connector main body 10, the engaging pieces 21 of the shield case 20 pass through the upper openings of the engaging groove portions 16 of the housing 11 and extend backwardly (refer to one of the engaging pieces 21 on the left side in FIG. 2). Afterward, the engaging pieces 21 are bent downwardly and accommodated in the engaging groove portions 16. At this time, while the base portions 21A of the engaging pieces 21 are smoothly inserted into the wide width groove portions 16A of the engaging groove portions 16, the free end portions 21B are tightly fitted into the narrow width groove portions 16B. In the state that the engaging pieces 21 are bent, as shown as the other of the engaging pieces 21 on the right side in FIG. 2, the attaching end portions 21C extend downwardly beyond the bottom surface of the shield case 20. The protruding portions constitute the attaching end portions 21C.

Then, the sub-engaging pieces 22 are bent upwardly to engage the rear surface of the housing 11 in the front-to-rear direction at the cut portions 17 of the housing 11. Accordingly, with the engaging pieces 21 and the sub-engaging pieces 22, the connector main body 10 firmly engages the shield case 20 to maintain the attached state. In particular, the engaging pieces 21 have a length over the whole height of the housing 11. Further, the free end portions 21B of the engaging pieces 21 are fitted into the narrow width groove portions 16B of the engaging groove portions 16, thereby achieving a large holding force. As a result, the shield case 20 is completely attached to the connector main body 10, thereby obtaining the connector with the shield case.

As shown in FIG. 2, the connector is then placed on the attaching object member such as a circuit board at a specific location. Then, the ground connecting portions 23 and the attaching end portions 21C of the engaging pieces 21 are inserted into corresponding holes P1 and P2, respectively, and connected to corresponding circuit with solder and the like. As a result, the engaging pieces 21 of the connector are fixed to the circuit board to hold the connector main body 10 over the whole height of the connector.

Accordingly, in a state that the mating connector is connected, when the electrical device is dropped and a force is applied to the connector main body 10 in the vertical direction, the engaging pieces 21 effectively prevent the front end portion of the connector main body 10 from being inclined vertically. Therefore, even when such a force is applied, the engaging pieces 21 do not open. Further, even when an undesirable twisting force is applied to the housing 11, it is possible to withstand such a twisting force and maintain the housing 11 in the normal state.

The present invention is not limited to the embodiment shown in FIG. 1 and FIG. 2, and various modifications are possible.

Figure 3:
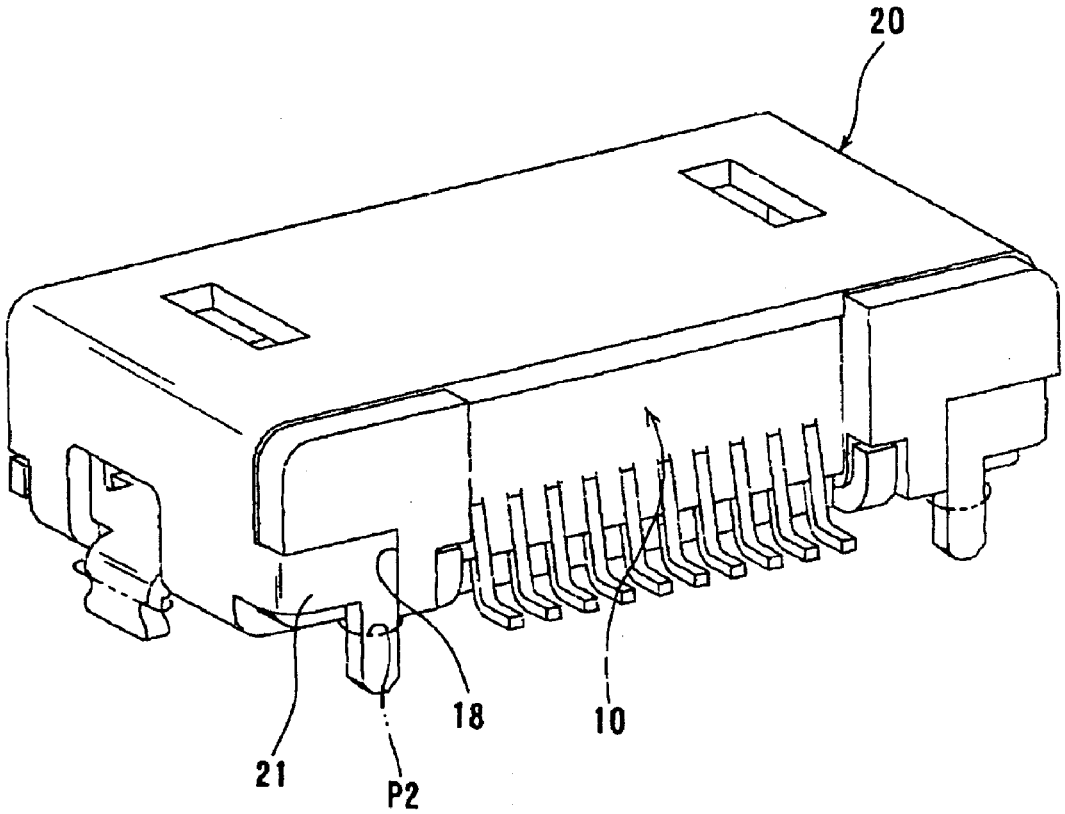
FIG. 3 is a perspective view showing a connector according to a second embodiment of the present invention.

In the embodiment shown in FIG. 1, the engaging pieces 21 extend backwardly and linearly from the upper rear edge of the shield case 20. In an embodiment shown in FIG. 3, the engaging pieces 21 extend from rear side portions. As shown in FIG. 3, the engaging pieces 21 extend from the rear side portions of the shield case 20, especially from lower portions thereof, and continue to extend in the width direction while changing a direction to form an L character shape. After the engaging pieces 21 shown in FIG. 3 are bent, the L character shape portions are accommodated in corresponding cut portions 18 to hold the rear surface of the housing 11 from both sides.

In this case, engaging grooves may be formed in the housing 11, so that parts of the engaging pieces 21 are fitted therein.

Figure 4:
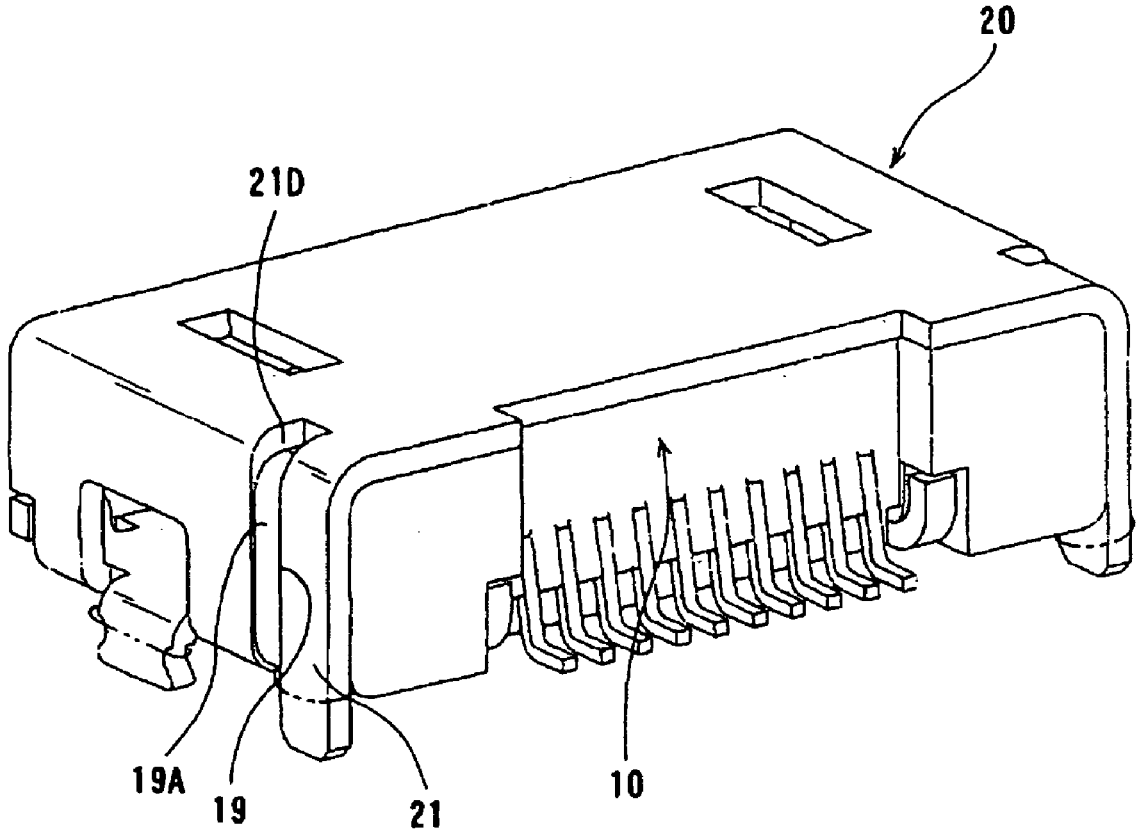
FIG. 4 is a perspective view showing a connector according to a third embodiment of the present invention.
Figure 5:
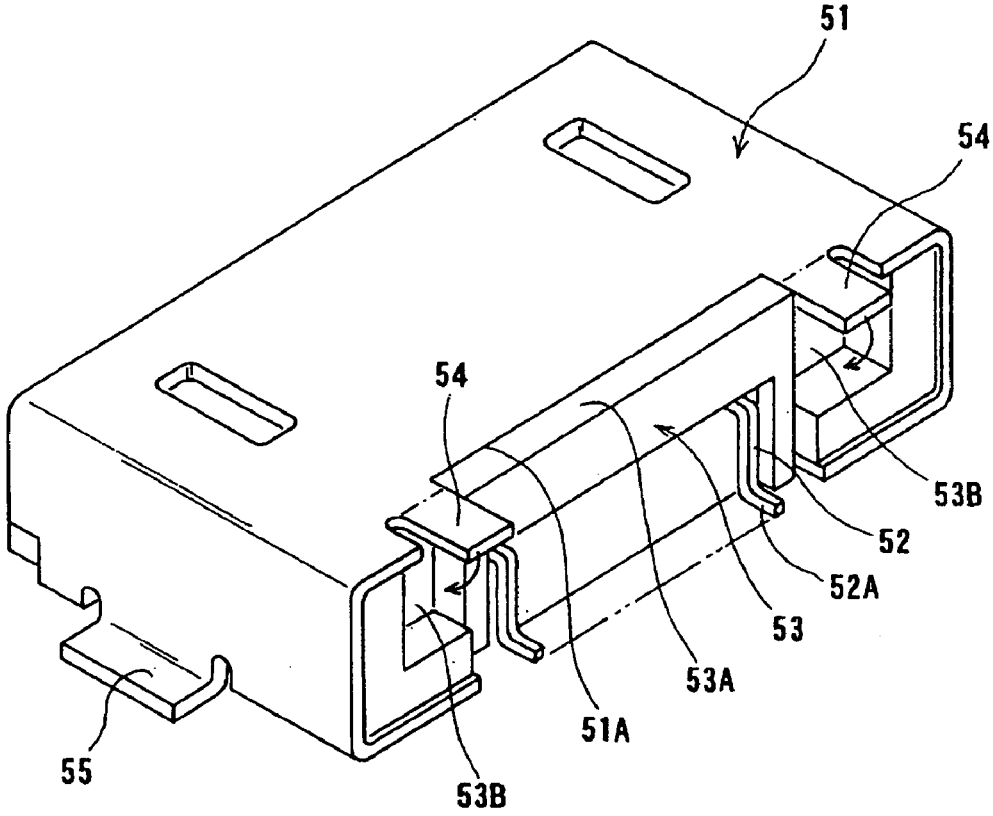
FIG. 5 PRIOR ART
FIG. 5 is a perspective view showing a conventional connector with a shield case.

In an embodiment shown in FIG. 4, the engaging pieces 21 extend sideway from upper rear side edges of the shield case 20. After the engaging pieces 21 shown in FIG. 4 are bent, the engaging pieces 21 are accommodated in corresponding cut portions 19 formed in side surfaces of the housing 11. In this state, corresponding protrusions 19A of the housing 11 are accommodated in groove portions 21D formed between the engaging pieces 21 and the shield case 20 for engaging the shield case 20 in the front-to-rear direction. That is, before the engaging pieces 21 are bent, when the shield case 20 is attached to the connector main body 10, front inner surfaces of the groove portions 21D function as stopper portions upon fitting. After the engaging pieces 21 are bent, front and rear inner surfaces of the groove portions 21D prevent the shield case 20 from coming off in both directions. Accordingly, in the embodiment shown in FIG. 4, it is not necessary to provide the stopper portions shown in FIG. 1.

The disclosure of Japanese Patent Application No. 2005-186582, filed on Jun. 27, 2005, is incorporated in the application.

While the invention has been explained with reference to the specific embodiments of the invention, the explanation is illustrative and the invention is limited only by the appended claims.

What is claimed is:

1. An electric connector for receiving a mating connector and to be attached to an attaching object member, comprising:

a housing having a front portion for receiving the mating connector along a first direction, said housing including an attaching portion extending in a second direction perpendicular to the first direction;

a shield case attached to the housing; and a pair of engaging pieces respectively disposed at both sides of the attaching portion in the second direction and extending from the shield case for engaging the housing, each of said engaging pieces including an attaching end portion to be inserted into a corresponding hole formed in the attaching object member.

2. The electric connector according to claim 1, wherein said attaching end portion extends downwardly beyond a bottom surface of the housing.

3. The electric connector according to claim 1, wherein said housing includes an engaging groove in a rear surface thereof, at least one of said engaging pieces extending from an upper rear end portion of the shield case so that the one of the engaging pieces is accommodated in the engaging groove.

4. The electric connector according to claim 1, wherein said housing includes an engaging groove or a step portion in a rear surface thereof, at least one of said engaging pieces extending from a rear end side portion of the shield case and having an L character shape so that the one of the engaging pieces is accommodated in the engaging groove or the step portion.

5. The electric connector according to claim 1, wherein said housing includes an engaging groove or a step portion in a side surface thereof, at least one of said engaging pieces extending from a rear end of the shield case so that the one of the engaging pieces is accommodated in the engaging groove or the step portion.

6. The electric connector according to claim 1, wherein said housing includes a stopper portion for abutting against the shield case so that the shield case is positioned at a standard position.

7. The electric connector according to claim 1, further comprising a plurality of terminals arranged on the attaching portion along the second direction.

8. The electric connector according to claim 1, wherein said housing includes an engaging groove for accommodating at least a part of at least one of the engaging pieces.

9. The electric connector according to claim 8, wherein at least one of said engaging pieces further includes a base portion having a first width and a free end portion having a second width smaller than the first width.

10. The electric connector according to claim 9, wherein said engaging groove includes a wide width groove portion having a third width larger than the first width and a narrow width groove portion having a fourth width smaller than the third width so that the free end portion is tightly fitted into the narrow width groove portion.

* * * * *